US009785107B2

(12) United States Patent
Nagasaki

(10) Patent No.: US 9,785,107 B2
(45) Date of Patent: Oct. 10, 2017

(54) FRAME INCLUDING A POST AND A STAY AND IMAGE FORMING APPARATUS INCLUDING SAID FRAME

(71) Applicant: CANON KABUSHIKI KAISHA, Tokyo (JP)

(72) Inventor: Tsuyoshi Nagasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/995,335

(22) Filed: Jan. 14, 2016

(65) Prior Publication Data

US 2016/0209801 A1 Jul. 21, 2016

(30) Foreign Application Priority Data

Jan. 15, 2015 (JP) ..... 2015-005621

(51) Int. Cl.
*G03G 21/00* (2006.01)
*G03G 21/16* (2006.01)

(52) U.S. Cl.
CPC ..... *G03G 21/1619* (2013.01)

(58) Field of Classification Search
CPC ..... G03G 21/1619
USPC ..... 399/107
See application file for complete search history.

(56) References Cited

U.S. PATENT DOCUMENTS 5,243,386 A * 9/1993 Araki ..... G03B 27/526 399/93
2010/0014886 A1* 1/2010 Lee ..... G03G 21/16 399/107
2011/0123246 A1* 5/2011 Ando ..... G03G 21/1619 400/622
2013/0330100 A1* 12/2013 Funayama ..... G03G 21/1619 399/107

FOREIGN PATENT DOCUMENTS

JP 2010-210897 A 9/2010

* cited by examiner

*Primary Examiner* — Quana M Grainger
(74) *Attorney, Agent, or Firm* — Fitzpatrick, Cella, Harper & Scinto

(57) ABSTRACT

A frame for an image forming apparatus includes a first side plate and a second side plate, a post, and a stay. The post includes a first side portion which is a surface opposing the first side plate and which includes a first fastening portion to which the first side plate is fastened, and a second side portion which is formed by being bent from the first side portion in a direction substantially perpendicular to the first side portion and which includes a second fastening portion, to which the stay is fastened, positioned at a height different from a height of the first fastening portion with respect to the vertical direction. The second side portion is continuously formed at least from the first fastening portion to the second fastening portion with respect to the vertical direction.

24 Claims, 7 Drawing Sheets

FRAME INCLUDING A POST AND A STAY AND IMAGE FORMING APPARATUS INCLUDING SAID FRAME

FIELD OF THE INVENTION AND RELATED ART

The present invention relates to a frame for an image forming apparatus such as a printer, a facsimile machine, a copying machine or a multi-function machine having a plurality of functions of these machines, and relative to the image forming apparatus.

In many cases, a structure such as a frame for the image forming apparatus is provided with a large-sized opening, cut-away portion or the like in either one of a front, left and right sides thereof in order to permit supply of a recording material such as a sheet or an operation such as jam clearance. For this reason, in the case where a load is exerted from an outside, e.g., when the image forming apparatus is moved, there is a possibility that the structure deforms. Further, an installation surface, such as a floor on which the image forming apparatus is to be placed, is not necessarily a flat surface, but is distorted in some cases. In this way, in the case where the image forming apparatus is placed on the distorted installation surface, there is a possibility that the structure is deformed by the influence of this distortion. When the structure is deformed, an image forming portion for effecting image formation and a recording material feeding portion for feeding the recording material which are provided inside the frame are deviated in a mounting portion, so that there is a possibility that a quality of an image to be outputted lowers.

For this reason, a lowering in rigidity of the structure has been conventionally suppressed by increasing a plate thickness of a post, a stay and the like constituting the structure or by adding a reinforcing member. However, in this case, a weight of the structure itself increases, and in addition, a cost increases.

Therefore, a constitution in which a front side plate (first side plate) constituting a front surface portion of a main assembly structure is provided with a columnar member (post) at a side surface thereof and a columnar structural portion with a closed space in cross section is constituted by the side surface of the front side plate and the columnar member is employed to enhance rigidity (Japanese Laid-Open Patent Application (JP-A) 2010-210897).

As disclosed in JP-A 2010-210897, in the case of a structure including the columnar structural portion with the closed space in cross section, the rigidity can be ensured in a region of the closed space in cross section. However, in the case where a stay for connecting the columnar member and a rear side plate is connected with the columnar member at a position different from the front side plate, the rigidity at this fastening position is lessened. That is, the columnar structural portion constitutes the closed space in cross section by the front side plate and the columnar member, and therefore in a region where there is no front side plate, the closed space in cross section is not formed, so that the stay is fastened to the columnar member at a position where the closed space in cross section is interrupted. For this reason, the rigidity at this fastening position is lower than the rigidity at a portion where the front side plate exists. For this reason, in the case where a load is exerted on the image forming apparatus from an outside or in the case where the image forming apparatus is disposed on a distorted installation surface, there is a possibility that the structure deforms.

SUMMARY OF THE INVENTION

In view of the above-described circumstances, the present invention has been accomplished in order to realize a constitution capable of ensuring rigidity of a structure even when a stay is fastened to a post at a position different from a first side plate.

A principal object of the present invention is to provide a frame for an image forming apparatus in which rigidity is enhanced.

According to an aspect of the present invention, there is provided a frame for an image forming apparatus including an image forming portion, comprising: a first side plate and a second side plate which are provided opposed to each other, interposing the image forming portion therebetween; a post, provided along a vertical direction, to which the first side plate is fastened; and a stay provided so as to connect the post and the second side plate or a member fixed to the second side plate, wherein the post includes a first side portion which is a surface opposing the first side plate and which includes a first fastening portion to which the first side plate is fastened, and a second side portion which is formed by being bent from the first side portion in a direction substantially perpendicular to the first side portion and which includes a second fastening portion, to which the stay is fastened, positioned at a height different from a height of the first fastening portion with respect to the vertical direction, wherein the second side portion is continuously formed at least from the first fastening portion to the second fastening portion with respect to the vertical direction.

Further features of the present invention will become apparent from the following description of exemplary embodiments with reference to the attached drawings.

DESCRIPTION OF THE EMBODIMENTS

Figure 1:
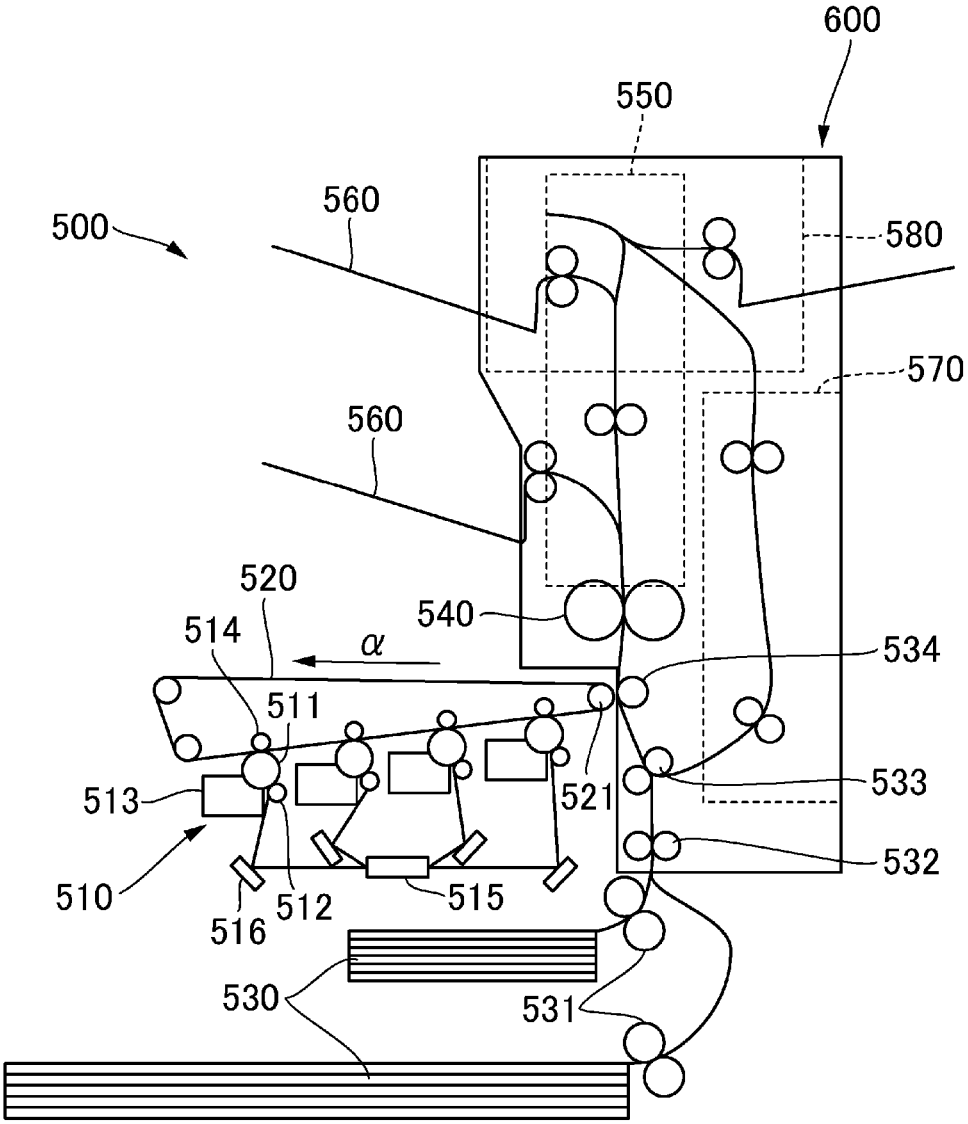
FIG. 1 is a schematic sectional view of an image forming apparatus according to an embodiment of the present invention.

Embodiments of the present invention will be described using FIGS. 1 to 9. First, using FIG. 1, a general structure of an image forming apparatus in an embodiment will be described.

[Image Forming Apparatus]

An image forming apparatus 500 is a so-called intermediary transfer tandem-type image forming apparatus in which four color image forming portions 510 are arranged along an intermediary transfer belt 520. In the intermediary transfer type, different from a direct transfer type, there is no need to hold a recording material on a transfer drum or a transfer belt, and therefore the intermediary transfer type can meet various recording materials such as ultra-thick paper and coated paper. Further, based on such a feature that a plurality of image forming portions are subjected to parallel process and images for a full-color image are collectively transferred, the intermediary transfer type is suitable for realizing high productivity.

The recording material is accommodated in a cassette 530 as a recording material accommodating portion capable of accommodating sheets of the recording material in such a form that the sheets are stacked on an unshown lift-up device. The recording material is, e.g., a sheet material such as paper (sheet) or an OHP sheet. The recording material in the cassette 530 is fed by a feeding device 531 by being timed to image formation of the image forming portions 510. The feeding device 531 may be of a type using frictional separation using a feeding roller or the like or a type using separation attraction by air. In this embodiment, the type using frictional separation using the feeding roller is employed.

The recording material fed by the feeding device 531 passes through a feeding path roller 532 and is fed to an oblique movement correction roller 533. After the oblique movement correction and timing correction are made by the oblique movement correction roller 533, the recording material is fed to a secondary transfer portion. The secondary transfer portion is a portion, formed by a secondary transfer inner roller 521 and a secondary transfer outer roller 534 which substantially oppose each other, for nipping and feeding the recording material. Then, by applying predetermined pressure and electrostatic load bias to the secondary transfer portion, as described later, toner images transferred on the intermediary transfer belt 520 are transferred onto the recording material.

At timing similar to timing of the above-described recording material feeding process to the secondary transfer portion, the toner images are fed to the secondary transfer portion in an image forming process. The image forming process will be described. The image forming portion 510 for each of the colors is principally constituted by a photosensitive drum (photosensitive member) 511 as an image bearing member, a charging device 512, a developing device 513, a primary transfer device 514 and the like. The structures of the image forming portions 510 for the respective colors are basically the same, and therefore the members for only a left-side image forming portion 510 are represented by reference numerals and those for other image forming portions will be omitted. In the case of this embodiment, the image forming portions for yellow (Y), magenta (M), cyan (C) and black (Bk) are disposed in this order from the left side in FIG. 1.

The photosensitive drum 511 is rotationally driven by an unshown motor. First, the surface of the photosensitive drum 511 is electrically charged uniformly by the charging device 512. Below the image forming portions 510, the exposure device 515 is provided. The exposure device 515 emits light on the basis of an image information signal sent from an external terminal such as an unshown scanner or an unshown personal computer externally connected with the image forming apparatus. The charged surface of the photosensitive drum 511 is irradiated with the emitted light (laser light) appropriately through a diffracting portion 516 or the like, so that an electrostatic latent image is formed on the surface of the photosensitive drum 511.

The thus-formed electrostatic latent image on the photosensitive drum 511 is developed with a toner into the toner image by the developing device 513. The toner image on the photosensitive drum 511 is transferred onto the intermediary transfer belt 520 under application of predetermined pressure and electrostatic load bias by the primary transfer device 514. The intermediary transfer belt 520 is stretched by a plurality of stretching rollers such as the secondary transfer inner roller 521, and is fed and driven in an arrow α direction in FIG. 1 by rotationally driving either of the stretching rollers.

Accordingly, the image forming processes for the respective colors which are made in parallel by the image forming portions for Y, M, C and Bk are carried out at timing when the associated toner image is superposed on the upstream toner image which has already been primary-transferred on the intermediary transfer belt 520. As a result, finally, a full-color toner image is formed on the intermediary transfer belt 520 and then is fed to the secondary transfer portion.

By the recording material feeding process and the toner image forming process which are described above, at the secondary transfer portion, the full-color toner image is secondary-transferred onto the recording material. Thereafter, the recording material is fed to a fixing device 540. The fixing device 540 melt-fixes the toner image on the recording material by applying predetermined pressure by substantially opposing belts, rollers or the like and by applying a heating effect on the toner image by a heat source such as a heater in general. The thus-obtained recording material on which a fixed image is carried passes through a post-fixing feeding portion 550 and then is discharged onto a discharge tray 560 as it is. Alternatively, in the case where double-side image formation is required, the recording material is fed to a reversal feeding device 570. A reversal discharging portion 580 reverses the recording material and then discharges the recording material onto a discharge tray 561. In this embodiment, a recording material feeding portion 600 is constituted by the fixing device 540, the post-fixing feeding portion 550, the reversal feeding device 570 and the reversal discharging portion 580.

[Structure]

The above-described constituent elements or units are supported by a main assembly structure 100 as a structure (frame) for the image forming apparatus. A general structure of the main assembly structure 100 will be described using FIG. 2. In the following description, "front" and "rear" are those with respect to a front side and a rear side, respectively, of the image forming apparatus, and "left" and "right" are those when the image forming apparatus is seen from the front side. The front side of the image forming apparatus is a side where an operator operates the image forming apparatus, e.g., where an operation panel is provided or a side where the cassette for accommodating the recording material is to be pulled out. Further, an up-down direction is that in a state in which the image forming apparatus is placed on an installation surface such as a floor.

The main assembly structure 100 includes a front side plate 101 as a first side plate, a rear side plate as a second side plate 102, a main base 103 as a connecting member, a right post 104 and a left post 105 which are posts, and the like. The main assembly structure 100 further includes a first lower right stay 106 as a stay, a second lower right stay 113 as a second stay, a lower left stay 107, a lower front stay 108, an upper right stay 109, a middle left stay 110, a middle right stay 111, an oblique stay 112, and the like.

The front side plate 101 and the rear side plate 102 are provided opposed and substantially in parallel to each other, interposing the image forming portions therebetween. The main base 103 not only connects the front side plate 101 and the rear side plate 102 but also on which the exposure device 515 is mounted. The right post 104 is provided along the up-down direction, is fastened to the front side plate 101, and extends downwardly to the neighborhood of the installation surface while supporting a right end of the front side plate 101. The left post 105 is provided along the up-down direction, is fastened to the front side plate 101, and extends downwardly to the neighborhood of the installation surface while supporting a left end of the front side plate 101.

The first lower right stay 106 is provided along a direction substantially perpendicular to the front side plate 101 so as to connect the right post 104 and the rear side plate 102 in the neighborhood of the installation surface, and regulates positions of these members with respect to a depth direction (front-rear direction) in the neighborhood of the installation surface. The first lower right stay 106 is provided, at an inner central surface thereof with respect to a width (left-right direction), with a rail 106*a* for guiding the cassette 50 to a main assembly of the image forming apparatus 500 in an insertable and pullable-out manner. The width direction refers to a direction (left-right direction) which is perpendicular to the up-down direction and which is parallel to the front side plate 101.

The second lower right stay 113 is disposed between the front side plate 101 and the first lower right stay 106 with respect to the up-down direction and is disposed toward a center more than the first lower right stay 106 with respect to the width direction parallel to the front side plate 101, and connects the right post 104 and the rear side plate 102. That is, the lower right stay 113 is disposed substantially parallel to the first lower right stay 106. Also at a widthwise inner surface of such a second lower right stay 113, a rail 113*a* for guiding a cassette 530 to the image forming apparatus 500 in an insertable and pullable-out manner is provided.

In this embodiment, the cassette 530 includes a two-stage structure, and a feeding path of the recording material from a lower-stage cassette 530 to an upper-stage cassette 530 is largely detoured in view of a load during feeding of the recording material. For this reason, the upper-stage cassette 530 is disposed at a position shifted leftward from the lower-stage cassette 530. Accordingly, the second lower right stay 113 for guiding the upper-stage cassette 530 is disposed at a position shifted leftward relative to the first lower right stay 106 for guiding the lower-stage cassette 530.

The lower left stay 107 is disposed in the neighborhood of the installation surface so as to connect the left post 105 and the rear side plate 102 and regulates positions of these members with respect to the depth direction in the neighborhood of the installation surface. The lower left stay 107 is provided at a widthwise inner central surface thereof with a rail 107*a* for guiding the cassette 50 to the main assembly of the image forming apparatus 500 in an insertable and pullable-out manner. The lower right stay 108 is disposed in the neighborhood of the installation surface so as to connect the right post 104 and the left post 105, and regulates positions of these posts with respect to the width direction in the neighborhood of the installation surface.

The upper right stay 109 is disposed so as to connect an upper end of the right post 104 and the rear side plate 102, and regulates positions of these members with respect to the depth direction at the upper end. The middle left stay 110 is disposed so as to connect an upper left end portion of the front side plate 101 and the rear side plate 102, and regulates these members at the positions with respect to the depth direction. The middle right stay 111 is disposed so as to connect an upper right peripheral portion of the front side plate 101 and the rear side plate 102, and regulates these members at the positions with respect to the depth direction. The oblique stay 112 is disposed so as to connect an upper left end portion of the front side plate 101 and a rear portion of the middle right stay 111, and suppresses distortion of the main assembly structure 100.

In the case of this embodiment, as shown in FIG. 1, the upper-stage cassette 530 and the lower-stage cassette 530 are provided and disposed in a lower space. For this reason, a lower front opening B between the front side plate 101 and the lower front stay 108 is largely provided. Further, as shown in FIG. 1, a recording material feeding portion 600 is provided on a right side of the image forming apparatus 500, so that also a right side opening C is largely provided in order to permit access to the recording material feeding portion 600 during jamming of the recording material in the feeding path of the recording material feeding portion 600 or the like.

The lower front opening B and the right side opening C which are largely provided as described above lower rigidity of the main assembly structure 100. Accordingly, unless the rigidity of the main assembly structure 100 is sufficiently ensured, the main assembly structure 100 is liable to cause distortion. When the main assembly structure 100 causes the distortion, alignment between the exposure device 515 and the photosensitive drum 511 and alignment between the secondary transfer inner roller 521 and the feeding device 531 are broken, so that an image defect such as color misregistration is liable to occur.

[Comparison Example]

Figure 2:
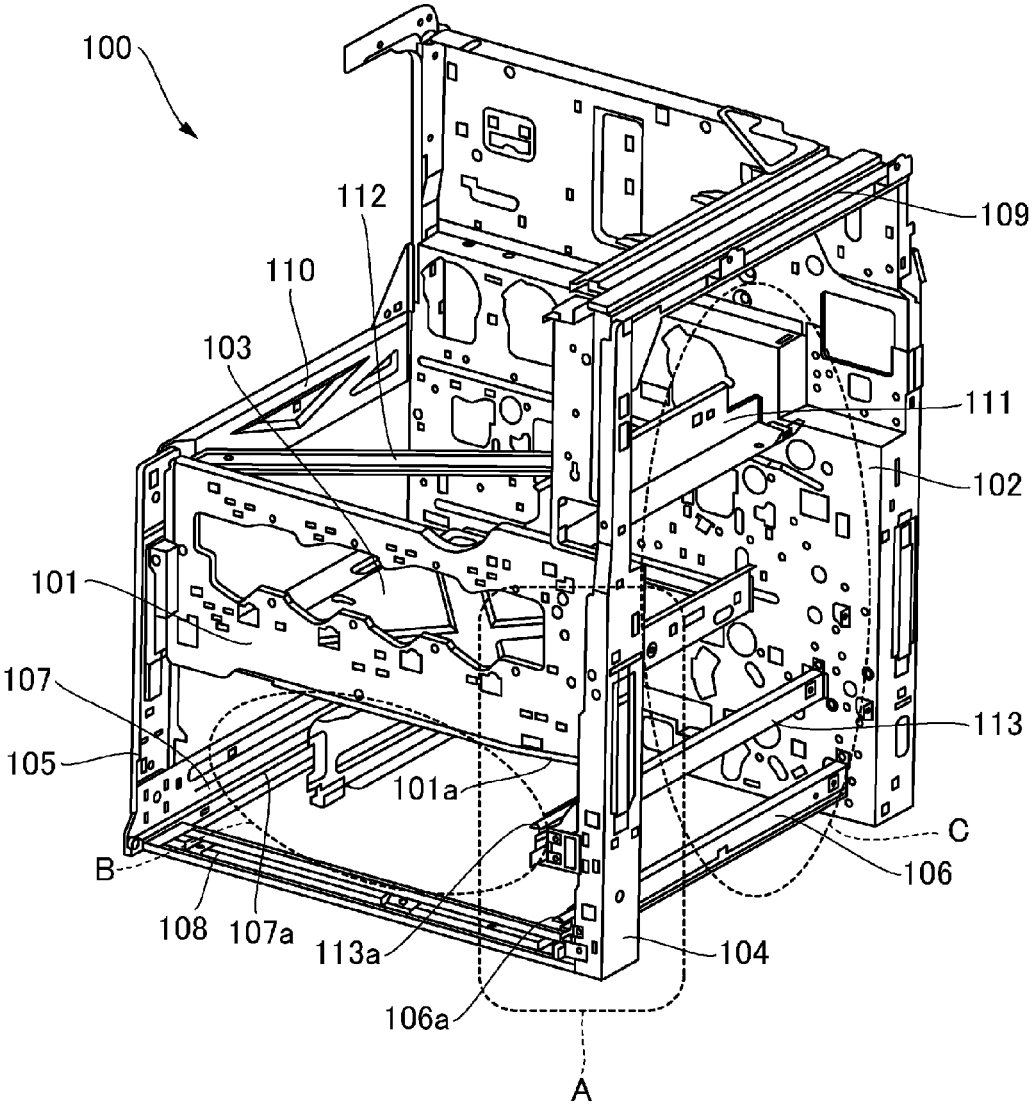
FIG. 2 is a perspective view of a structure (frame) for the image forming apparatus in the embodiment as seen from a front side.
Figure 3:
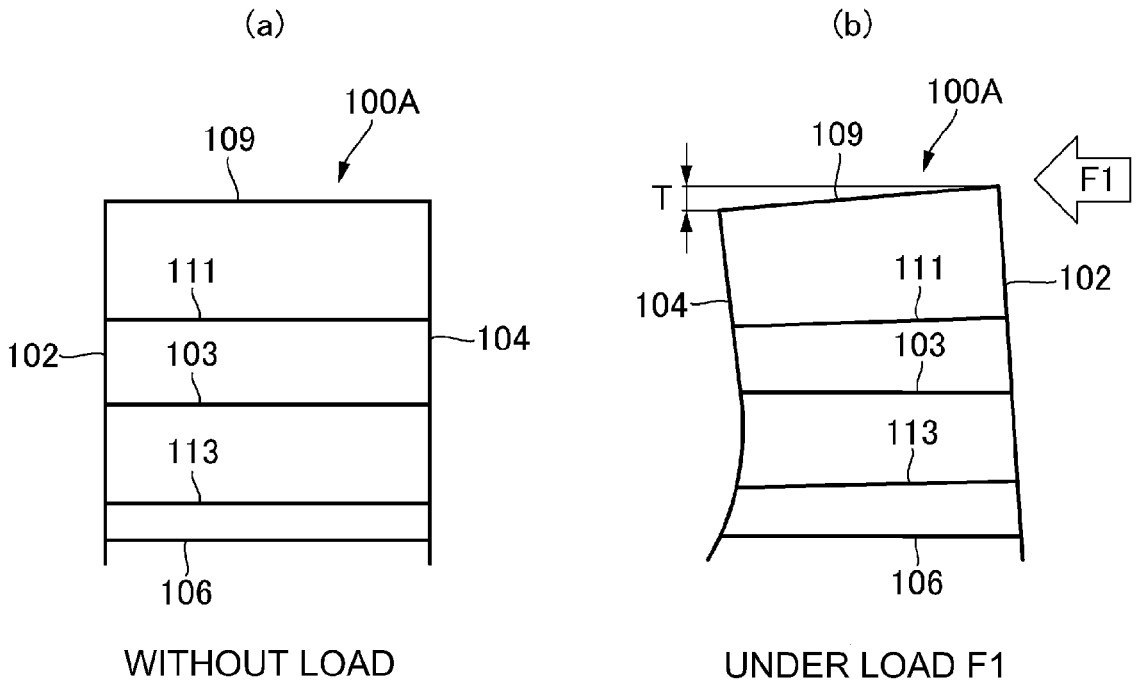
In FIG. 3, (a) and (b) are schematic views of a structure in Comparison Example, wherein (a) shows a state without load, and (b) shows a state under application of a horizontal load.

Comparison Example for the main assembly structure of the image forming apparatus will be described using (a) and (b) of FIG. 3. In Comparison Example shown in (a) and (b) of FIG. 3, different from this embodiment specifically described later, a right post 104 of a main assembly structure 100A is not provided with a flange portion, and (a) and (b) of FIG. 3 are schematic views of the main assembly structure 100A as seen from a right side. A basic structure other than the flange portion is similar to the structure described above with reference to FIG. 2, and constituent elements therefore will be represented by the same reference numerals. In FIG. 3, (a) shows a load-less state in which no load is exerted on the main assembly structure 100A, and (b) shows a loaded state in which a horizontal load F1 from a rear side toward a front side is exerted on the main assembly structure 100A at an upper right portion in (b) of FIG. 3.

In the main assembly structure 100A in Comparison Example, when the horizontal load F1 is exerted on the main assembly structure 100A, the right post 104 is liable to bent with a lower side point than the main base 103 as a point of bending since the lower front opening B largely opens. That is, the front side plate is out of alignment with the rear side plate 102 correspondingly to a height T, so that the main assembly structure 100A is liable to induce the image defect as described above. As disclosed in JP-A 2010-210897, when the right post 104 defining the closed space in cross section is formed so as to constitute a closed space region in cross section in cooperation with the front side plate, rigidity can be ensured in the closed space region in cross section. However, at a lower portion of the front side plate, the closed space in cross section is interrupted at fastening positions of the right post 104 with the first lower right stay 106 and the second lower right stay 113, and therefore the right post 104 is liable to bend at the interrupted positions as the point of inflection. Accordingly, also in the case of the constitution disclosed in JP-A 2010-210897, when the horizontal load F1 is exerted on the main assembly structure, alignment between the front side plate and the rear side plate 102 is liable to break.

[Fastening between right post and each of front side plate and first lower right stay]

For the reasons described above, in this embodiment, the right post 104 and the front side plate 101 and the right post 104 and the first lower right stay 106 are fastened, respectively, in the following manners. This will be describing using FIG. 4. The right post 104 is disposed in substantially perpendicular to the front side plate 101, and includes a side plate portion 104*a* (first side portion) to which the front side plate 101 is fastened at a plurality of first fastening portions f1. The side plate portion 104*a* is disposed opposed to a rear-side surface of a right end portion of the front side plate 101, the rear-side surface is fastened to the side plate portion 104*a* by welding at the plurality of first fastening portions f1 spaced therefrom upwardly and downwardly. As a result, the right end portion of the front side plate 101 is fixed and supported by the right post 104.

The right post 104 includes a flange portion 104*b* (second side portion) which is substantially perpendicular to the front side plate 101 and which is formed so as to extend from at least a part of the side plate portion 104*a* overlapping with the front side plate 101 toward the rear side plate 102 (second side plate). To the flange portion 104*b*, the lower right stay 106 is fastened at a plurality of second fastening portions f2 different in position from the first fastening portions f1 with respect to the up-down direction. The first lower right stay 106 is disposed along a direction substantially perpendicular to the front side plate 101, and therefore the flange portion 104*b* and the first lower right stay 106 are substantially perpendicular to each other. A widthwise outer surface (outside surface) of the first lower right stay 106 and the flange portion 104*b* are fastened by welding at the plurality of fastening portions f2.

Such a flange portion 104*b* is continuously formed at least from an overlapping position with the front side plate 101 to the second fastening portions f2. In the case of this embodiment, the flange portion 104*b* is continuously formed from the neighborhood of the lower-side first fastening portion f1 between the side plate portion 104*a* and the front side plate 101 to a lower end portion of the right post 104. Specifically, the flange portion 104*b* is formed continuously to a position adjacent to a third fastening portion f3 where the lower front stay 108 and the right post 104 are fastened to each other or to a position below the position adjacent to the third fastening portion f3.

The flange portion 104*b* and the front side plate 101 are fastened at the plurality of positions with respect to the up-down direction. For example, these portions are fastened at the first fastening portions f1 provided at 2 unshown upper positions and 2 unshown lower positions in a region where the flange portion 104*b* and the front side plate 101 oppose each other. Also in this case, in this embodiment, at least from the neighborhood of the lower-side two first fastening portions f1, particularly at least from above one of the two first fastening portions f1 toward below the fastening portion f1, the flange portion 104*b* is formed. The flange portion 104*b* may also be formed so as to contain all of an overlapping region between the side plate portion 104*a* and the front side plate 101 with respect to the up-down direction.

The flange portion 104*b* is fastened via the second lower right stay 113 and a relay member 114 which are positioned above the first lower right stay 106. As described above, the second lower right stay 113 is disposed toward the widthwise center (at the position shifted leftward) more than the first lower right stay 106. For this reason, by disposing the relay member 114 between the flange portion 104*b* and the second lower right stay 113, the second lower right stay 113 and the flange portion 104*b* can be fastened. The relay member 114 includes a relay plate 114*a* perpendicular to the flange portion 104*b* and a pair of mounting plates bent perpendicularly from both ends of the relay member 114. The pair of mounting plates is fastened to an outer surface of the second lower right stay 113 and the flange portion 104*b* by welding. The relay member 114 and the flange portion 104*b* are fastened at a fourth fastening portion f4.

[Cross-Sectional Shape of Right Post]

Figure 5:
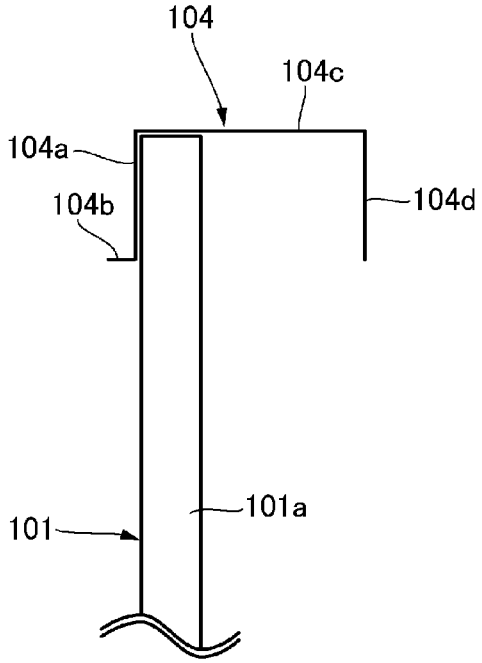
FIG. 5 is a schematic sectional view showing a state in which a right post in the embodiment is cut at a fastening portion to a front side plate.

A cross-sectional surface of the right post 104 in this embodiment is shown in FIG. 5. FIG. 5 schematically shows a cross section of the right post 104 and the front side plate 101 in the neighborhood of the fastening portion. The right post 104 in this embodiment includes a bent portion 104*c* (third side portion) and a second bent portion (fourth side portion) in addition to the side plate portion 104*a* and the flange portion 104*b* which are described above. As shown in FIG. 5, with respect to a parallel widthwise direction, the flange portion 104*b* is formed by being bent from one end portion of the side plate portion 104*a* corresponding to the central end portion of the front side plate 101 toward the rear side plate 102. On the other hand, with respect to the widthwise direction, the bent portion 104*c* bent from the other end portion of the side plate portion 104*a* at substantially right angles toward a side (front side) opposite to the rear side plate 102 is provided. Further, at a free end of the bent portion 104*c*, the second bent portion 104*d* bent from the free end toward a widthwise central portion of the front side plate 101 is provided. As a result, the right post 104 has the cross-sectional shape as shown in FIG. 5.

Figure 6:
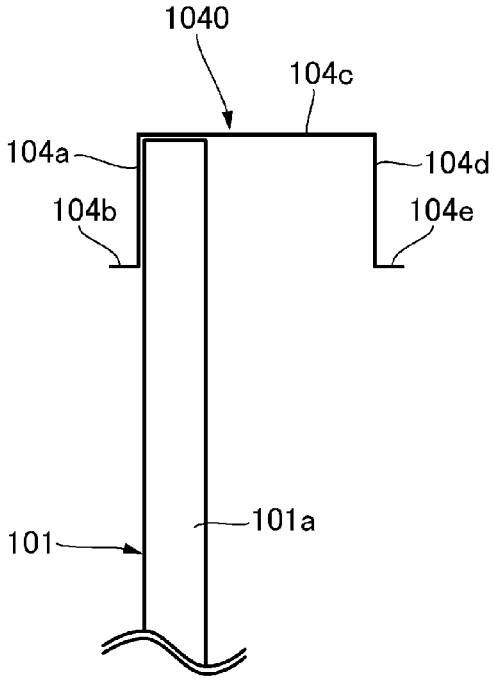
FIGS. 6 to 8 are schematic sectional views each showing another example of a state in which the right post in the embodiment is cut at the fastening portion to the front side plate.

In this embodiment, the shape in cross section of the right post 104 is constituted as described above, rigidity of the right post 104 is efficiently enhanced. However, in order to further enhance the rigidity of the right post 104, as shown in FIG. 6, the bent portion is further increased from the shape of FIG. 5. That is, such a right post 1040 that a third bent portion 104*e* (fifth side portion) bent from a free end of the second bent portion 104*d* is provided may also be used. The third bent portion 104*e* is bent toward the front side. In other words, the shape shown in FIG. 6 is such that the cross-sectional surface is obtained by bending both ends of one side once in the same direction and then by bending each of free ends of the bent portions toward the outside.

Figure 7:
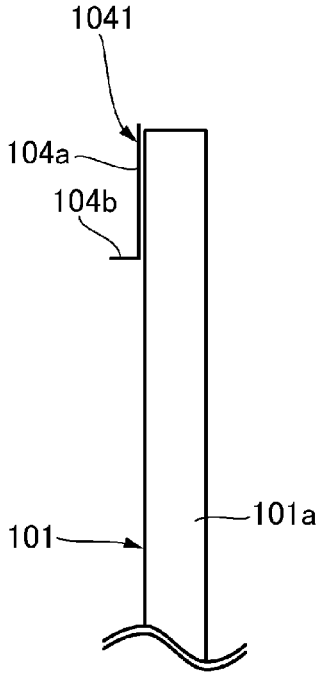
Figure 8:
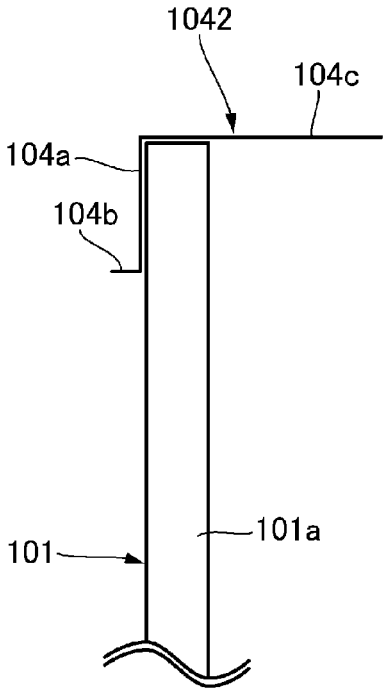

Further, in the case where the main assembly structure does not require the right post to have the rigidity as in this embodiment due to the lower front opening B smaller than that in this embodiment, right posts 1041, 1042 as shown in FIGS. 7, 8 may also be used. The right post 1041 shown in FIG. 7 has a substantially L-shape in cross section consisting of the side plate portion 104*a* and the flange portion 104*b*. The right post 1042 shown in FIG. 8 has a substantially crank shape in cross section consisting of the side plate portion 104*a*, the flange portion 104*b* and the bent portion 104*c*.

[Lower End Flange Portion]

Figure 4:
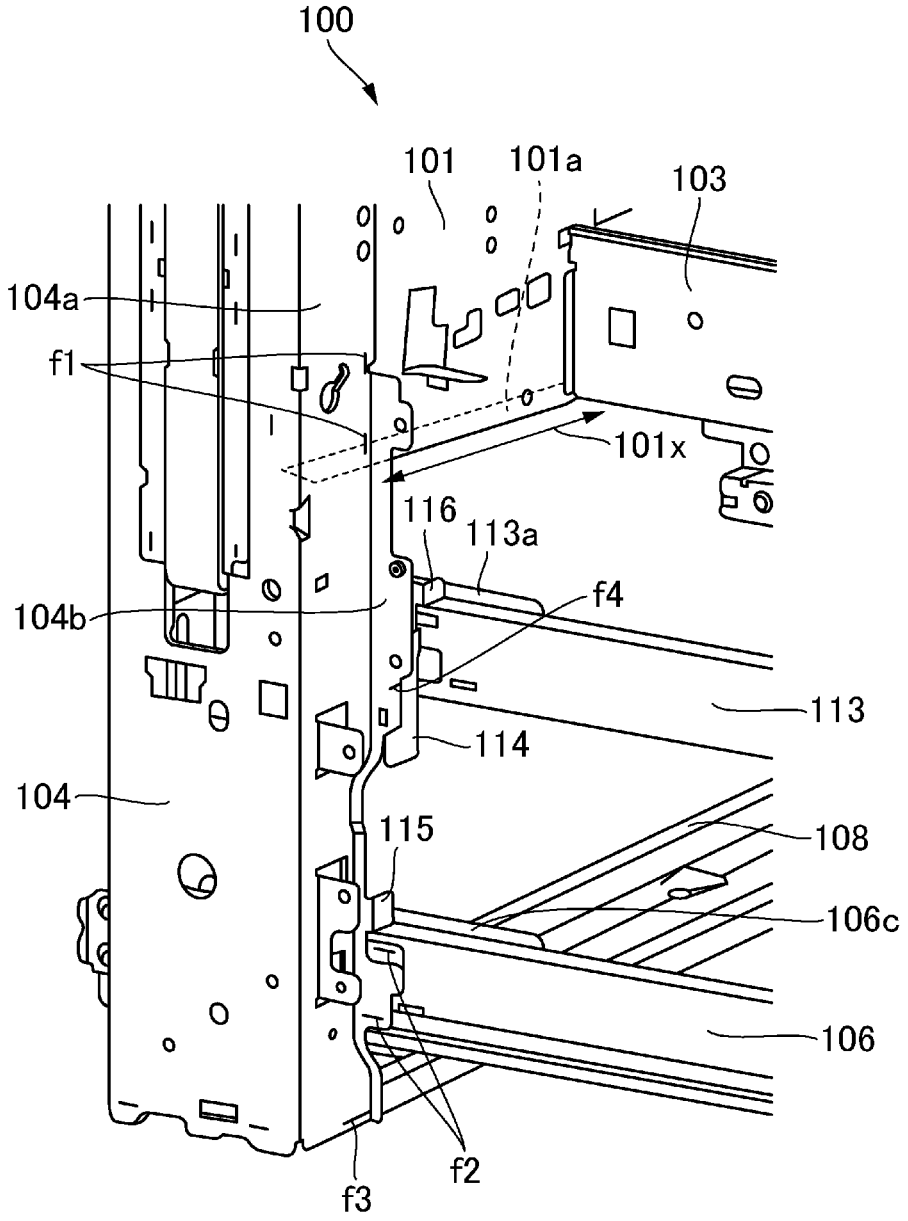
FIG. 4 is an enlarged perspective view of portion A of FIG. 2 as seen from a rear side.

In the image forming apparatus 500 in this embodiment, as shown in FIG. 1, the recording material feeding portion 600 is provided on the right side of the image forming apparatus 500. For this reason, as shown in FIG. 2, the main base 103 connecting the front side plate 101 and the rear side plate 102 is fastened to the front side plate 101 so that the right end portion thereof toward the right post 104 is positioned toward the central portion of the side plate 101 more than the right post 104. For this reason, the main base 103 is interrupted partway at a position close to a right end of the front side plate 101 and does not continuously extend to the right post 104. For this reason, at a right end portion of the front side plate 101, as shown in FIG. 4, there is a main base-less region 101X where there is no main base 103. In such a main base-less region 101X, the rigidity lowers.

Therefore, the front side plate 101 includes a lower end flange portion 101*a* as a second flange portion which continuously extends between the right post 104 and the fastening portion to the main base 103 and which is bent in a direction perpendicular to each of the front side plate 101 and the flange portion 104*b* . In this embodiment, the lower end flange portion 101*a* bent from the lower end portion of the front side plate 101 toward the front side is provided at least between the main base 103 and the flange portion 104*b* of the right post 104. The lower end flange portion 101*a* is provided so as to continuously extend from a widthwise intermediary portion to the right end portion of the main base 103 and so as to cross the flange portion 104*b*.

[Structure in the neighborhood of stopper portion]

Figure 9:
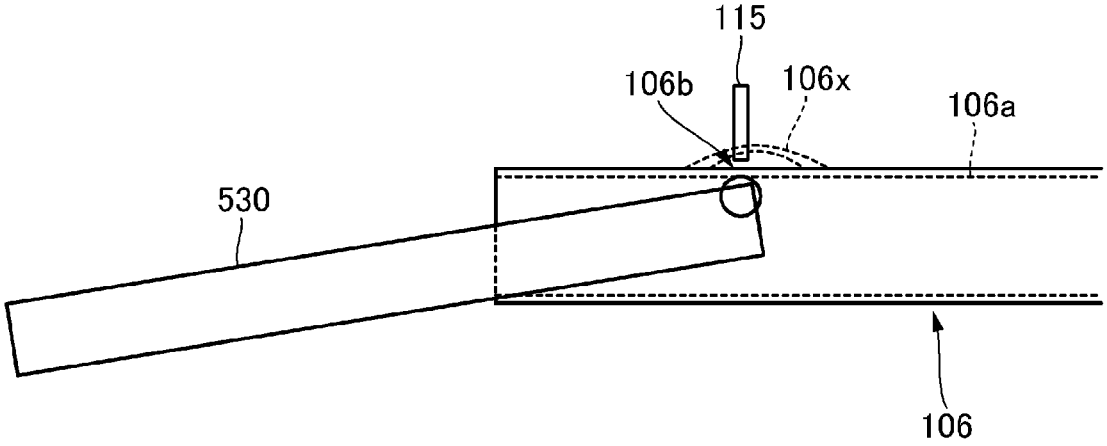
FIG. 9 is a schematic view of a stopper portion and a reinforcing portion of a first lower right stay in the embodiment in a state in which a cassette is pulled out.

When an operator such as a user pulls out the cassette 530 toward the front side for the purpose of, e.g., supplying the recording material, as shown in FIG. 9, a front-side portion of the cassette 530 lowers. FIG. 9 shows a state in which the lower-stage cassette 530 is pulled out toward the front side and schematically illustrates a relationship between the first lower right stay 106 and the cassette 530 in the case where the cassette 530 and the first lower right stay 106 are viewed from the right side.

As shown in FIG. 9, when the cassette 530 is pulled out to a supplying position for permitting supply of the recording material to the cassette 530, the cassette 530 swings by its own weight, so that an upstream-side portion (right-side portion in FIG. 9) thereof with respect to a pulling-out direction. Then, a part of an upstream-side upper surface of the cassette 530 with respect to the pulling-out direction contacts a part of the rail 106*a* of the first lower right stay 106 at a contact position 106*b*. That is, in this embodiment, the part of the rail 106*a* functions as a stopper for suppressing a lowering of the cassette 530 when the cassette 530 is pulled out.

However, in the pulled-out state of the cassette 530, when the recording material is stacked in the cassette 530 in a full state or when the operator imposes a downward load on the cassette 530, a large load is exerted on the rail 106*a* at the portion functioning as the stopper. By this load, there is a possibility that the first lower right stay 106 causes deformation 106*x*. In a conventional constitution, as a countermeasure thereto, a thickness of the first lower right stay was increased or a reinforcing plate was additionally provided.

On the other hand, in this embodiment, in order to suppress the deformation of the first lower right stay 106 due to the lowering of the cassette 530, the right post 104 is provided with a reinforcing portion 115 bent from a part of the flange portion 104*b*. The reinforcing portion 115 is bent from the upper side of the first lower right stay 106 toward the inside with respect to the widthwise direction as shown in FIG. 4 and is disposed close to or in contact with the upper portion of the above-described contact position 106*b*. In this embodiment, the reinforcing portion 115 is disposed close to the upper portion of the contact position 106*b*. In other words, in this embodiment, using the flange portion 105*b*, the reinforcing portion 115 is disposed in the neighborhood of the upper portion of the contact position 106*b*.

In the case of this embodiment, the first lower right stay 106 is provided with a stay-side flange portion 106*c* bent upward in the neighborhood of the contact position 106*b*. That is, as shown in FIG. 4, the stay-side flange portion 106*c* is formed in a predetermined range including the contact position 106*b* of the first lower right stay 106 by being bent upward. As a result, the rigidity of the first lower right stay 106 in the neighborhood of the contact position 106*b* can be enhanced, so that it is possible to efficiently suppress the above-described deformation of the first lower right stay 106 due to the lowering of the cassette 530.

In this embodiment, also the second lower right stay 113 is provided with a similar structure. That is, as shown in FIG. 4, a reinforcing portion 116 is formed by being bent from an upper side of the second lower right stay 113 contacting the flange portion 104*b* toward a widthwise inside. The reinforcing portion 116 is disposed close to or in contact with a contact position similarly as in the case of the first lower right stay 106. Further, also the second lower right stay 113 is provided with a stay-side flange portion 113*b* bent upward in the neighborhood of the contact position.

In the case of this embodiment employing such a constitution, even when the first lower right stay 106 is fastened to the right post 104 at a position different from the front side plate 101, the rigidity of the main assembly structure 100 can be ensured. That is, in the case of this embodiment, the right post 104 is provided with the flange portion 104*b* continuously extending at least from the overlapping position with the front side plate 101 to the second fastening portion f2. The flange portion 104*b* is formed not only substantially perpendicular to the front side plate 101 but also so as to extend from at least a part of an overlapping portion of the side plate portion 104a with the front side plate 101 toward the rear side plate 102. For this reason, the rigidity of the right post 104 is increased.

Particularly, between the front side plate 101 and the first lower right stay 106, there is a space where the cassette 530 is disposed, and therefore the rigidity of the right post 104 in this region is liable to lower. As shown in (b) of FIG. 3, bending is liable to occur in this region in the case where the horizontal load is exerted as described above. On the other hand, in this embodiment, the right post 104 is provided with the flange portion 104*b* at least in this region, and therefore it is possible to diminish the generation of bending.

The lower right stay 106 is fastened at the second fastening portion f2 to the flange portion 104*b* formed so as to extend toward the rear side plate 102. For this reason, the first lower right stay 106 is supported between the right post 104 and the rear side plate 102, so that the above-described bending can be efficiently suppressed.

The lower front stay and the right post 104 are fastened by the third fastening portion f3 in the neighborhood of the flange portion 104*b* For this reason, the point of inflection is not formed on the right post 104 at a position between the lower front stay 108 and the first lower right stay 106, so that the bending of the right post 104 can be suppressed. Above the first lower right stay 106, the second lower right stay 113 disposed on the widthwise central side and the flange portion 104*b* are fastened via the relay member 114. For this reason, the second lower right stay 113 can be efficiently caused to more efficiently contribute to the improvement in rigidity of the main assembly structure 100.

In this embodiment, the lower end flange portion 101*a* is formed in the main base-less region 101X between the right post 104 and the fastening portion between the front side plate 101 and the main base 103. The lower end flange portion 101*a* and the flange portion 104*b* of the right post 104 are caused to cross each other. For this reason, the bending of the front side plate 101 in the main base-less region 101X can be suppressed without increasing the thickness of the front side plate 101.

Thus, in this embodiment, the rigidity of the main assembly structure 100 can be improved without increasing the thicknesses of the respective members and without separately providing a reinforcing member. As a result, even when the image forming apparatus 500 is disposed on the distorted installation surface or even when the load is exerted on the image forming apparatus 500 in order to move the image forming apparatus 500, the distortion of the main assembly structure 100 can be suppressed, so that the image defect can be suppressed.

<Other Embodiments>

In the above-described embodiment, the case where the present invention is applied to the structure (frame) for the image forming apparatus of the intermediary transfer tandem type was described.

However, the present invention is also applicable to structures for image forming apparatuses of other types such as a rotary type in which a plurality of image forming portions are disposed in a cylindrical shape and a direct transfer type in which the toner image is directly transferred from the photosensitive drum onto the recording material.

The present invention is applicable to not only the right post but also the left post. The stay connecting the right post or the left post with the rear side plate may also be a stay other than the lower-side stay such as the first lower right stay.

The fastening between the stay and the rear side plate may also be made by, other than direct fastening between the stay and the rear side plate, fastening the stay to a member fixed to the rear side plate such as the post. The fastening of the respective members may also be made by, other than the welding, another fastening means such as caulking, a screw, or a combination of a bolt and a nut.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-005621 filed on Jan. 15, 2015, which is hereby incorporated by reference herein in its entirety.

What is claimed is:

1. A frame for an image forming apparatus including an image forming portion, said frame comprising:

a first side plate and a second side plate which are provided opposed to each other, interposing the image forming portion therebetween;

a post, provided along a vertical direction, to which said first side plate is fastened; and a stay provided so as to connect said post and said second side plate or a member fixed to said second side plate, wherein said post includes:

a first side portion which is a surface opposing said first side plate and which includes a first fastening portion to which said first side plate is fastened, and a second side portion formed by being bent from said first side portion in a direction substantially perpendicular to said first side portion, wherein said second side portion is a surface opposing said stay and includes a second fastening portion, to which said stay is fastened, positioned at a height different from a height of said first fastening portion with respect to the vertical direction, wherein said second side portion is continuously formed at least from said first fastening portion to said second fastening portion with respect to the vertical direction.

2. A frame according to claim 1, wherein said second side portion is formed by bending said first side portion at one end side in the direction substantially perpendicular to said first side portion, wherein said post includes a third side portion formed by bending said first side portion at another end side in a direction opposite to said second side portion with respect to said first side portion.

3. A frame according to claim 2, wherein said post is formed by bending said third side portion and includes a fourth side portion opposing said second side portion.

4. A frame according to claim 3, wherein said post includes a fifth side portion formed by bending said fourth side portion in a direction substantially perpendicular to said fourth side portion.

5. A frame according to claim 1, further comprising a connecting member for connecting said first side plate and said second side plate, wherein said connecting member has a post-side end portion fastened to said first side plate inside said first side plate more than said post, and wherein said first side plate includes a second flange portion bent continuously between said post and a fastening portion to said connecting member in a direction perpendicular to each of said first side plate and said second side portion.

6. An image forming apparatus comprising:

(i) an image forming portion for forming an image on a recording material; and (ii) a frame for accommodating said image forming portion, wherein said frame includes:

(ii-i) a first side plate and a second side plate which are provided opposed to each other, interposing said image forming portion therebetween, (ii-ii) a post, provided along a vertical direction, to which said first side plate is fastened, and (ii-iii) a stay provided so as to connect said post and said second side plate or a member fixed to said second side plate, wherein said post includes, (ii-ii-i) a first side portion which is a surface opposing said first side plate and which includes a first fastening portion to which said first side plate is fastened, and (ii-ii-ii) a second side portion formed by being bent from said first side portion in a direction substantially perpendicular to said first side portion, wherein said second side portion is a surface opposing said stay and includes a second fastening portion, to which said stay is fastened, positioned at a height different from a height of said first fastening portion with respect to the vertical direction, wherein said second side portion is continuously formed at least from said first fastening portion to said second fastening portion with respect to the vertical direction.

7. An image forming apparatus according to claim 6, wherein said second side portion is formed by bending said first side portion at one end side in the direction substantially perpendicular to said first side portion, wherein said post includes a third side portion formed by bending said first side portion at another end side in a direction opposite to said second side portion with respect to said first side portion.

8. An image forming apparatus according to claim 7, wherein said post is formed by bending said third side portion and includes a fourth side portion opposing said second side portion.

9. An image forming apparatus according to claim 8, wherein said post includes a fifth side portion formed by bending said fourth side portion in a direction substantially perpendicular to said fourth side portion.

10. An image forming apparatus according to claim 6, further comprising a connecting member for connecting said first side plate and said second side plate, wherein said connecting member has a post-side end portion fastened to said first side plate inside said first side plate more than said post, and wherein said first side plate includes a second flange portion bent continuously between said post and a fastening portion to said connecting member in a direction perpendicular to each of said first side plate and said second side portion.

11. An image forming apparatus according to claim 6, wherein said frame further includes a second stay, provided between said first side plate and said stay with respect to the vertical direction, inside said frame more than said stay, wherein said second stay is fastened to said second side portion of said post via a relaying member.

12. An image forming apparatus according to claim 6, further comprising a recording material accommodating portion capable of accommodating the recording material, wherein said recording material accommodating portion is provided in a stay-side space of said first side plate.

13. An image forming apparatus according to claim 12, wherein said stay includes a rail for guiding said recording material accommodating portion so as to be insertable into and pullable out from a main assembly of said image forming apparatus.

14. An image forming apparatus according to claim 13, wherein said post includes a reinforcing portion provided by being bent from said second side portion in proximity to or in contact with an upper portion of a contact position where a part of an upper surface of said recording material accommodating portion at an upstream side with respect to a pulling-out direction contacts said reinforcing portion at a part of said stay when said recording material accommodating portion is pulled out to a supplying position where the recording material is to be supplied to said recording material accommodating portion.

15. An image forming apparatus according to claim 14, wherein said stay includes a stay-side flange portion bent upwardly in a neighborhood of the contact position.

16. An image forming apparatus according to claim 6, further comprising a feeding portion for feeding the recording material, wherein said recording material feeding portion is provided in a space provided above said stay in a stay side.

17. An image forming apparatus comprising:

(i) an image forming portion configured to form an image on a recording material;

(ii) a feeding path, provided in one end side with respect to a widthwise direction of said image forming apparatus, configured to feed the recording material;

(iii) a cassette, provided below said image forming portion, configured to accommodate the recording material; and (iv) a frame configured to accommodate said image forming portion and said feeding path, wherein said frame includes:

(iv-i) a first side plate and a second side plate, provided opposed to each other while interposing said image forming portion therebetween, wherein below said first side plate, an opening configured to permit pulling-out of said cassette is provided, (iv-ii) a post, provided along a vertical direction, to which said first side plate is fastened, said post being provided in the same side as said feeding path with respect to the widthwise direction of said image forming apparatus, and (iv-iii) a stay provided so as to connect said post and said second side plate or a member fixed to said second side plate, said stay being disposed at a height corresponding to the opening, wherein said post includes:

(iv-ii-i) a first side portion which is a surface opposing said first side plate and which includes a first fixing portion to which said first side plate is fixed, (iv-ii-ii) a second side portion which is a surface opposing said first side portion, (iv-ii-iii) a third side portion which is a surface connecting said first side portion and said second side portion, and (iv-ii-iv) a flange portion formed by being bent from said first side portion toward said second side portion, wherein said flange portion includes a second fixing portion, to which said stay is fixed, positioned at a height different from a height of said first fixing portion with respect to the vertical direction, and wherein said flange portion is continuously formed at least from said first fixing portion to said second fixing portion with respect to the vertical direction.

18. An image forming apparatus according to claim 17, wherein said first side plate and said post are fixed to each other by welding, and wherein said flange portion and said stay are fixed to each other by welding.

19. An image forming apparatus according to claim 17, wherein said stay includes a rail configured to guide said cassette.

20. An image forming apparatus according to claim 17, wherein said stay is fixed to said flange portion with respect to the vertical direction.

21. An image forming apparatus comprising:

(i) an image forming portion configured to form an image on a recording material;

(ii) a feeding path, provided in one end side with respect to a widthwise direction of said image forming apparatus, configured to feed the recording material;

(iii) a plurality of cassettes, provided below said image forming portion, configured to accommodate the recording material; and (iv) a frame configured to accommodate said image forming portion and said feeding path, wherein said frame includes:

(iv-i) a first side plate and a second side plate, provided opposed to each other while interposing said image forming portion therebetween, wherein below said first side plate, an opening is provided and configured to permit pulling-out of said plurality of cassettes, (iv-ii) a post, provided along a vertical direction, to which said first side plate is fastened, said post being provided in the same side as said feeding path with respect to the widthwise direction of said image forming apparatus, and (iv-iii) a plurality of stays provided so as to connect said post and said second side plate or a member fixed to said second side plate, each of said plurality of stays being disposed at a height corresponding to the opening, wherein said post includes:

(iv-ii-i) a first side portion which is a surface opposing said first side plate and which includes a first fixing portion to which said first side plate is fixed, (iv-ii-ii) a second side portion which is a surface opposing said first side portion, and (iv-ii-iii) a third side portion which is a surface connecting said first side portion and said second side portion, and (iv-ii-iv) a flange portion formed by being bent from said first side portion toward said second side portion, wherein said flange portion includes a plurality of second fixing portions, each corresponding to an associated one of said plurality of stays, to which the associated one of said plurality of stays is fixed, positioned at a height different from a height of said first fixing portion with respect to the vertical direction, and wherein said flange portion is continuously formed at least from said first fixing portion to an uppermost portion of said plurality of second fixing portions with respect to the vertical direction and said flange portion is continuously formed at least between said plurality of second fixing portions.

22. An image forming apparatus according to claim 21, wherein said first side plate and said post are fixed to each other by welding, and wherein said flange portion and each of said stays are fixed to each other by welding.

23. An image forming apparatus according to claim 21, wherein each of said plurality of stays includes a rail configured to guide an associated one of said plurality of cassettes.

24. An image forming apparatus according to claim 21, wherein each of said plurality of stays is fixed to said flange portion with respect to the vertical direction.

* * * * *